US008074830B2

(12) United States Patent
Pomfrey

(10) Patent No.: US 8,074,830 B2
(45) Date of Patent: Dec. 13, 2011

(54) RECLOSABLE CONTAINER AND CLOSURE THEREFOR

(75) Inventor: Sarah Nicole Pomfrey, Cambridge (CA)

(73) Assignee: Maple Leaf Foods Inc., Toronto (CA)

( * ) Notice: Subject to any disclaimer, the term of this patent is extended or adjusted under 35 U.S.C. 154(b) by 0 days.

(21) Appl. No.: 12/717,727

(22) Filed: Mar. 4, 2010

(65) Prior Publication Data

US 2011/0215024 A1 Sep. 8, 2011

(51) Int. Cl.
*B65D 41/16* (2006.01)

(52) U.S. Cl. ..... 220/788; 220/790; 220/791

(58) Field of Classification Search ..... 220/276, 220/780, 784, 786, 790, 792, 788, 791; 426/106, 426/129

See application file for complete search history.

(56) References Cited

U.S. PATENT DOCUMENTS

| | | | | |
|---|---|---|---|---|
| 3,320,993 | A * | 5/1967 | Motsenbocker | 220/780 |
| 3,344,974 | A | 10/1967 | Bostrom, III | |
| 3,467,244 | A | 9/1969 | Mahaffy et al. | |
| 3,734,276 | A | 5/1973 | Bank | |
| 3,903,309 | A | 9/1975 | Mahaffy et al. | |
| 4,055,671 | A | 10/1977 | Mahaffy et al. | |
| 5,377,860 | A * | 1/1995 | Littlejohn et al. | 220/790 |
| 5,423,453 | A | 6/1995 | Fritz | |
| 5,520,939 | A | 5/1996 | Wells | |
| 5,758,794 | A * | 6/1998 | Rider et al. | 220/786 |
| 5,762,231 | A * | 6/1998 | Rider et al. | 220/786 |
| 5,795,604 | A | 8/1998 | Wells et al. | |
| 6,032,827 | A * | 3/2000 | Zettle et al. | 220/784 |
| 6,085,930 | A | 7/2000 | Curtis | |
| 6,910,599 | B2 | 6/2005 | Tucker et al. | |
| 6,959,829 | B2 * | 11/2005 | Crider et al. | 220/790 |
| 7,169,419 | B2 | 1/2007 | Dalton et al. | |
| 7,475,780 | B2 | 1/2009 | Hinze et al. | |
| D600,113 | S | 9/2009 | Edwards et al. | |
| D603,697 | S | 11/2009 | Edwards et al. | |
| 2004/0062838 | A1 | 4/2004 | Castellanos et al. | |
| 2005/0233036 | A1 | 10/2005 | Feldmeier et al. | |
| 2007/0045317 | A1 | 3/2007 | Rosender et al. | |
| 2008/0118609 | A1 | 5/2008 | Harlfinger | |
| 2008/0160143 | A1 | 7/2008 | Edwards et al. | |
| 2009/0321462 | A1 | 12/2009 | Hui | |

FOREIGN PATENT DOCUMENTS

| | | | |
|---|---|---|---|
| CA | 2434721 | A1 | 3/2004 |
| CA | 2543176 | A1 | 5/2005 |
| CA | 2486019 | A1 | 10/2005 |
| CA | 2596218 | A1 | 8/2006 |

(Continued)

*Primary Examiner* — Bryon Gehman
(74) *Attorney, Agent, or Firm* — Marshall, Gerstein & Borun LLP

(57) ABSTRACT

A reclosable container for a food product comprises a rigid or semi-rigid tray and lid. The tray and lid each have a peripheral edge portion having substantially vertical inner and outer walls joined by a horizontal flange, wherein the container is closed with the tray peripheral edge portion received inside a cavity defined by the lid peripheral edge portion. An outer detent mechanism is provided at one or more corners of the container, such as diagonally opposed corners which may also include lift tabs. The corners at which outer detent mechanisms are located may have straight corner transition portions about which the lid may pivot during opening of the container. The sides of the tray and lid peripheral edge portions may be substantially flat and free of projections, so that only the corners with the outer detent mechanisms offer significant resistance against opening.

17 Claims, 8 Drawing Sheets

FOREIGN PATENT DOCUMENTS

| | | | |
|---|---|---|---|
| CA | 2601386 | A1 | 6/2008 |
| CA | ID 121005 | | 11/2009 |
| CA | ID 132697 | | 11/2009 |
| DE | 295 15 199 | U1 | 2/1996 |
| EP | 0 117 673 | A2 | 9/1984 |
| EP | 1 777 169 | A2 | 4/2007 |

* cited by examiner

RECLOSABLE CONTAINER AND CLOSURE THEREFOR

FIELD OF THE INVENTION

The invention relates to a reclosable food container comprising a tray and a lid, and to easy opening closures for such containers.

BACKGROUND OF THE INVENTION

Food products such as meats are often packaged for sale in reclosable, rigid or semi-rigid plastic containers comprising a tray and a lid. Prior to first opening of the container, the food product is enclosed within a hermetically sealed product compartment within the tray. Upon first opening of the container, the hermetic seal is destroyed. The container can then be reclosed by applying the lid to the tray, for example to maintain freshness of unused portions of the food product for a relatively short period of time. A hermetic seal is not formed between the lid and tray when the container is reclosed.

Convenience and ease of use are important properties of these containers, and may have an impact on acceptance of a particular food product by consumers. It is common for reclosable food containers to incorporate a detent mechanism to provide an interlocking or "snap" fit between the tray and the lid. Such detent mechanisms may provide an audible sound and/or a tactile sensation which assures the user that the lid has snapped into engagement with the tray and that the container is therefore closed. The detent mechanism may be in the form of one or more ribs or similar protrusions extending along the edges of the tray and/or lid. One problem with such a detent closure mechanism is that it may make it more difficult to apply or remove the lid from the tray. For example, it may be necessary to firmly press the lid onto the tray about its entire periphery to engage the detent mechanism, and to gradually peel the lid from the tray to disengage the detent mechanism. On the other hand, the complete absence of a detent mechanism would cause the lid to fit loosely on the tray and make it difficult to keep the tray closed.

There remains a need for a reclosable food container which can be easily opened and reclosed, yet provides a reliable closure with an audible noise and/or a tactile sensation to signify complete engagement of the lid and the tray.

SUMMARY OF THE INVENTION

In one aspect, the invention provides a reclosable container for a food product. The container comprises a tray having a base and an upstanding sidewall extending from the base. The base and the sidewall together define a compartment for the food product, and the sidewall terminates in a peripheral edge portion.

The container further comprises a lid having a central panel surrounded by a peripheral edge portion. The peripheral edge portions of the tray and lid each have four sides and four corners, and each comprise an inner wall, an outer wall spaced from the inner wall, and a flange connecting the inner and outer walls at their upper edges. The inner wall of the tray peripheral edge portion extends upwardly from the sidewall, and the inner wall of the lid peripheral edge portion extends upwardly from the central panel.

The container further comprises a first outer detent mechanism which is located at a first corner of the lid peripheral edge portion and a corresponding first corner of the tray peripheral edge portion. The first outer detent mechanism comprises a male detent element projecting inwardly from the outer wall of the lid peripheral edge portion and a female detent element projecting inwardly from the outer wall of the tray peripheral edge portion. The male and female detent elements are positioned so that the male detent element is nested with the female detent element when the container is closed.

In another aspect, the peripheral edge portions of the tray and the lid are generally rectangular.

In yet another aspect, the first corner at which the first outer detent mechanism is located is shaped to define a first corner transition portion which forms an included angle of greater than 90 degrees with each of the adjoining sides, and the first outer detent mechanism is located at the first corner transition portion. For example, the first outer detent mechanism may be provided in the substantially straight portion of the first corner transition portion.

In yet another aspect, the first corner transition portion includes a substantially straight portion which forms an included angle of about 135 degrees with each of the adjoining sides.

In yet another aspect, the male detent element of the outer detent mechanism projects inwardly at an angle of about 45-90 degrees to the outer wall of the lid peripheral edge portion, and the female detent element projects inwardly at an angle of about 45-90 degrees to the outer wall of the tray peripheral edge portion. The angle of about 45-90 degrees is defined in a vertical plane passing through the first outer detent element. In another aspect, the angle is from about 60-90 degrees.

In yet another aspect, the male detent element projects sharply and abruptly inwardly from the outer wall of the lid peripheral edge portion, and the female detent element projects sharply and abruptly inwardly from the outer wall of the tray peripheral edge portion, when the male and female detent elements are viewed in a vertical plane passing through the first outer detent element.

In yet another aspect, the male and female detent elements each comprise one or more dimples having upper and lower surfaces spaced from the respective upper and lower edges of the outer walls of the tray and lid peripheral edge portions.

In yet another aspect, the container further comprises a second outer detent mechanism located at a second corner of the lid peripheral edge portion and a corresponding corner of the tray peripheral edge portion. The second outer detent mechanism is the same as the first outer detent mechanism. The first and second corners at which the first and second outer detent mechanisms are located may be located diagonally opposite to one another. Furthermore, the second corner may be shaped to define a second corner transition portion at which the second outer detent mechanism is located, with the second corner transition portion including a substantially straight portion which forms an included angle of about 135 degrees with each of the adjoining sides.

In yet another aspect, the container may further comprise at least one lift tab extending outwardly from the outer wall of the lid peripheral edge portion at the corner at which the first outer detent mechanism is located.

In yet another aspect, the inner and outer walls of the tray and lid peripheral edge portions are substantially flat and planar along the sides thereof.

In yet another aspect, the inner and outer walls of the tray and lid peripheral edge portions are substantially free of projections along the sides thereof.

BRIEF DESCRIPTION OF DRAWINGS

The invention will now be described, by way of example only, with reference to the accompanying drawings in which.

DETAILED DESCRIPTION

Figure 1:
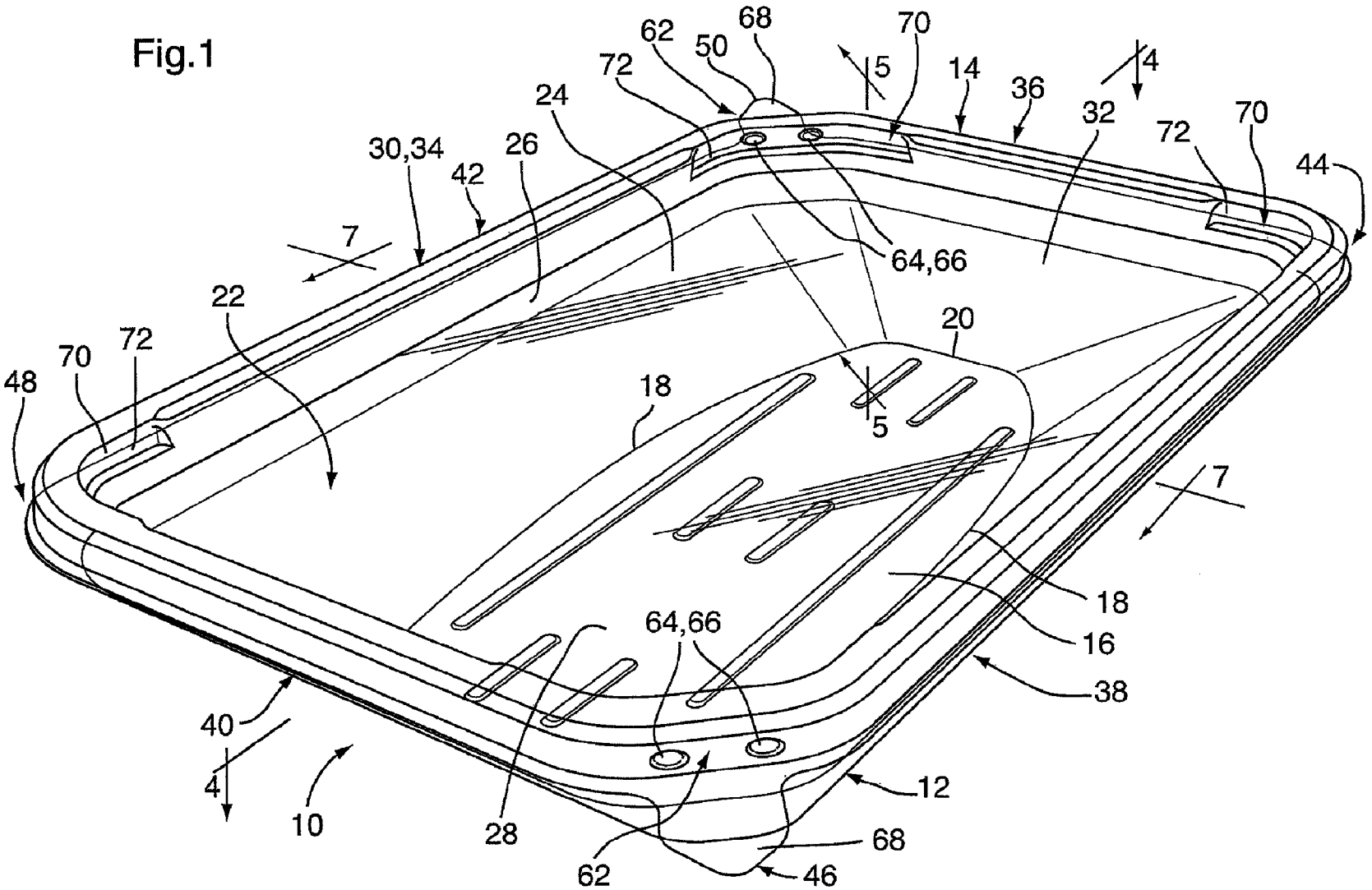
FIG. 1 is a perspective view of a reclosable container according to the invention, with the lid applied to the tray.

A reclosable container 10 for a food product is illustrated in the drawings, and is now described below.

The reclosable container 10 comprises a tray 12 and a lid 14, both of which may be made from a rigid or semi-rigid plastic film which is formed into the illustrated shapes by application of heat and/or pressure. In the illustrated container 10 the tray 12 and lid 14 are made from a transparent plastic film, but it will be appreciated that the tray 12 and/or lid 14 could instead be formed from translucent or opaque plastic films.

The following description uses terms such as "upper", "lower", "upward", "downward", "top", "bottom", "vertical", "horizontal" and variants of these terms to indicate position and orientation of certain elements of the container 10. It will be understood that these terms are used to describe the orientation of the container 10 as illustrated in the drawings, in which the lid 12 is generally shown to be on top of the tray 14 and the tray 12 is resting on its base. Also, terms such as "inner", "outer", "inward" and "outward" and variants thereof are used for descriptive purposes in order to indicate relative distance from a center of the tray 12 or the lid 14.

The tray 12 comprises a generally flat base 16 on which the container 10 is supported. The base 16 is generally rectangular in shape, having a periphery defined by two relatively long edges 18 and two relatively short edges 20 joined by rounded corners, with at least the long edges 18 being outwardly convex relative to the center of the base 16. The tray 12 further comprises a sidewall 22 which surrounds the base 16 and defines the four sides of the tray 12, extending upwardly and outwardly from the edges 18, 20 of base 16. The sidewall 22 includes a lower, outwardly sloped portion 24 and an upper, substantially vertical portion 26 which has a generally rectangular outer periphery. The base 16 and sidewall 22 of tray 12 together define at least part of a product compartment for a food product such as meat (not shown). The illustrated container 10 is particularly well suited for packaging of elongate meat products, such as bacon strips. It will be appreciated, however, that other types of food products may be packaged in container 10, and that the shape and dimensions of the tray 12 and lid 14 may be adjusted so as to provide a product compartment suitable to receive other food products.

The tray 12 further comprises a peripheral edge portion 30 which extends upwardly from the vertical portion 26 of sidewall 22 and is generally rectangular in shape. The peripheral edge portion 30 of tray 12 (also referred to herein as the "tray peripheral edge portion") is further described below.

The lid 14 is also generally rectangular in shape so as to completely cover the open top of tray 12, and comprises a flat central panel 32 surrounded by a peripheral edge portion 34. The peripheral edge portion 34 of the lid 14 (also referred to herein as the "lid peripheral edge portion") is further described below.

As shown in the drawings, the tray and lid peripheral edge portions 30, 34, the base 16, the sidewall 22 and the central panel 32 are all generally rectangular, each having four sides. This provides the container 10 with an overall elongate, rectangular shape. This rectangular shape is best seen in the plan view of FIG. 4. It will be appreciated that the shape of container 10 may be varied so that the four sides of the base 16, sidewall 22, central panel 32 and peripheral edge portions 30, 34 are all of substantially the same length so that the container 10 has an overall square shape when viewed in plan. Throughout the following description, unless otherwise indicated, the term "rectangular" is to be understood as including square shapes.

Alternatively, some or all of the angles between the four sides of the base 16, sidewall 22, central panel 32 and peripheral edge portions 30, 34 may be greater or less than 90 degrees such that the container 10 has an overall shape of a rhombus, parallelogram, trapezoid or other four-sided polygon when viewed in plan. Alternatively, the container according to the invention is not necessarily four-sided, but may be in the shape of a triangle, pentagon, hexagon or other polygonal shape.

The elements making up the tray and lid peripheral edge portions 30, 34 are substantially identical to one another, and are therefore identified in the drawings with like reference numerals, with the reference numerals of the lid peripheral edge portion 34 being primed. For the sake of convenience, the following description uses the same reference numerals to identify the elements of the peripheral edge portions 30, 34, except where it is necessary to distinguish between the tray and lid peripheral edge portions 30, 34, in which case the elements of the lid peripheral edge portion 34 are identified by primed reference numerals.

As shown in the drawings, the tray and lid peripheral edge portions 30, 34 each have four sides connected by four corners. The four sides are identified by reference numerals 36, 38, 40, 42 and the four corners are identified by reference numerals 44, 46, 48, 50. The sides 36, 38, 40, 42 are shown as being substantially straight, although this not necessarily the case. Rather, the sides may be either concavely or convexly curved relative to the center of the container 10. Adjacent pairs of sides 36, 38, 40, 42 of container 10 are shown as being at right angles to one another. It will be appreciated that this is not essential. Rather, the angle between adjacent sides 36, 38, 40 and 42 may be either less than or greater than 90 degrees without departing from the scope of the invention.

The corners 44, 46, 48, 50 are not square, but rather are shaped so as to define corner transition portions which may, for example, be rounded or chamfered so as to form an included angle greater than the included angle between the two sides to which they are joined which, in the illustrated embodiment, is about 90°. These corner transitions are now described below in greater detail.

The tray and lid peripheral edge portions 30, 34 both include two diagonally opposed corners 44, 48 which are rounded so as to form smoothly curved corner transition portions extending between two adjoining sides, each describing an arc of approximately 90 degrees. For example, as shown in the plan view of FIG. 4, an included angle θ between a tangent T at any point along the curved transition portion of corner 44, and either of the sides 36, 38 to which it is joined, is greater than about 90°.

Figure 4:
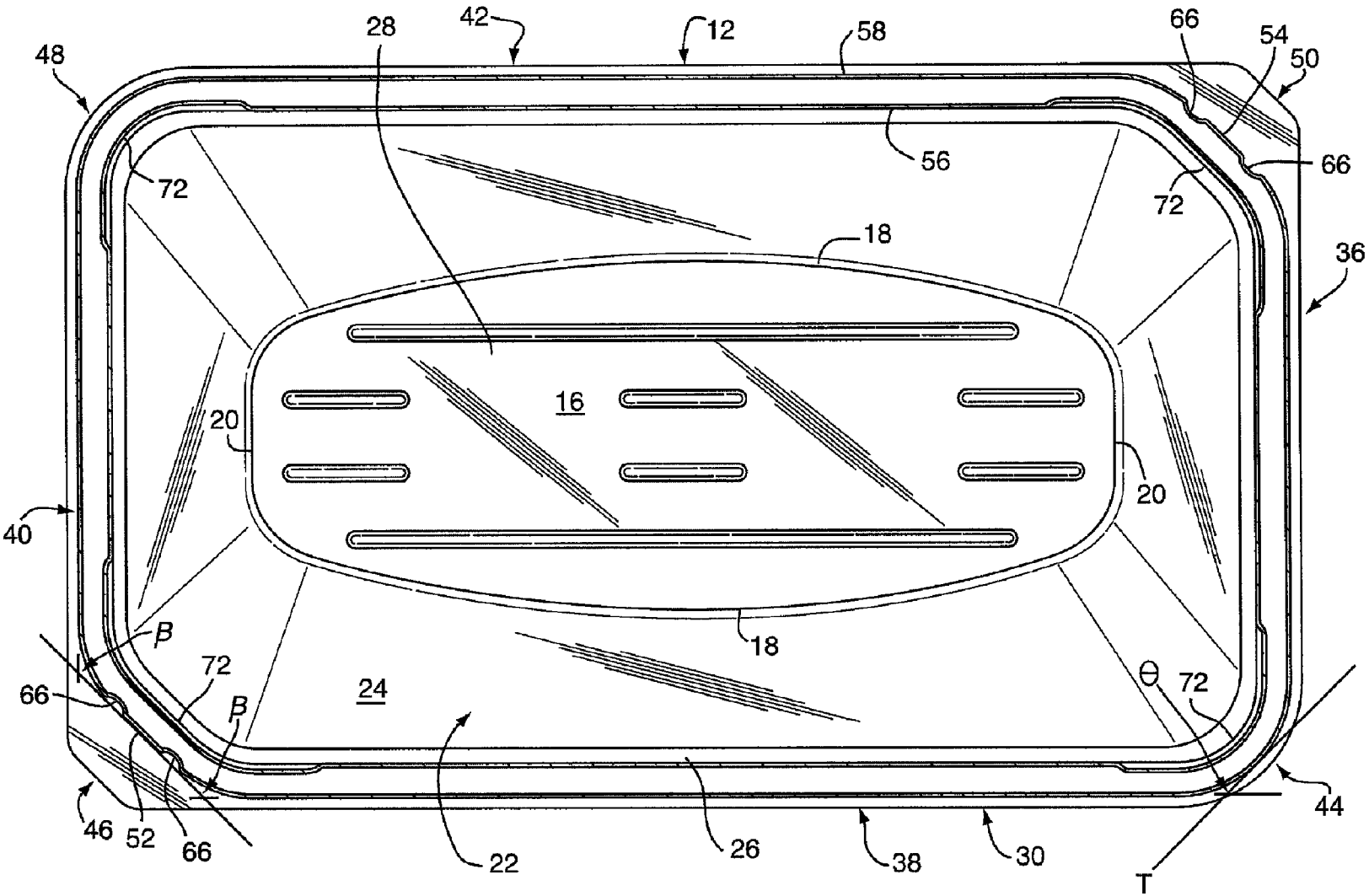
FIG. 4 is a cross-section along line 4-4 of FIG. 1.

Both the tray and lid peripheral edge portions 30, 34 also include two diagonally opposed corners 46, 50 which are chamfered so as to form substantially straight transition portions 52, 54 extending between two adjoining sides. For example, as shown in FIG. 4, the straight transition portion 52 at corner 46 forms an included angle β of about 135° with both of the sides 38, 40 to which it is joined. Also as shown in FIG. 4, a smoothly curved transition may be formed between the straight portions 52, 54 and the sides to which they are joined.

The provision of two different corner shapes and the positioning of similarly shaped corners diagonally opposite to one another ensure that the lid 14 can only be applied to tray 12 in one orientation. The significance of this feature will become apparent from the description below.

The cross-sectional shapes of the peripheral edge portions 30, 34 are now described below with reference to FIGS. 4 to 7. As seen in the cross-sections, the tray and lid peripheral edge portions 30, 34 are generally U-shaped in cross-section and are made up of three elements: an inner wall 56, an outer wall 58 which is spaced from the inner wall 56, and a flange 60 connecting the inner and outer walls 56, 58 at their upper edges. Each of these elements extends about the entire peripheral edge portions 30, 34 of both the tray and lid 12, 14, including all four sides 36, 38, 40, 42 and all four corners 44, 46, 48, 50.

In the embodiment shown in the drawings, the inner and outer walls 56, 58 are both substantially vertical and parallel to one another, and the flange 60 is substantially horizontal. Also, for reasons which will become apparent below, the portions of the inner and outer walls 56, 58 which extend along the sides 36, 38, 40, 42 are substantially flat and planar and are free of projections. Furthermore, the flange 60 is substantially flat and planar and, as shown in FIG. 7, a rounded or chamfered transition may be provided between the flange 60 and the adjoining inner and outer walls 56, 58, particularly along the sides 36, 38, 40, 42 of the peripheral edge portions 30, 34.

Figure 7:
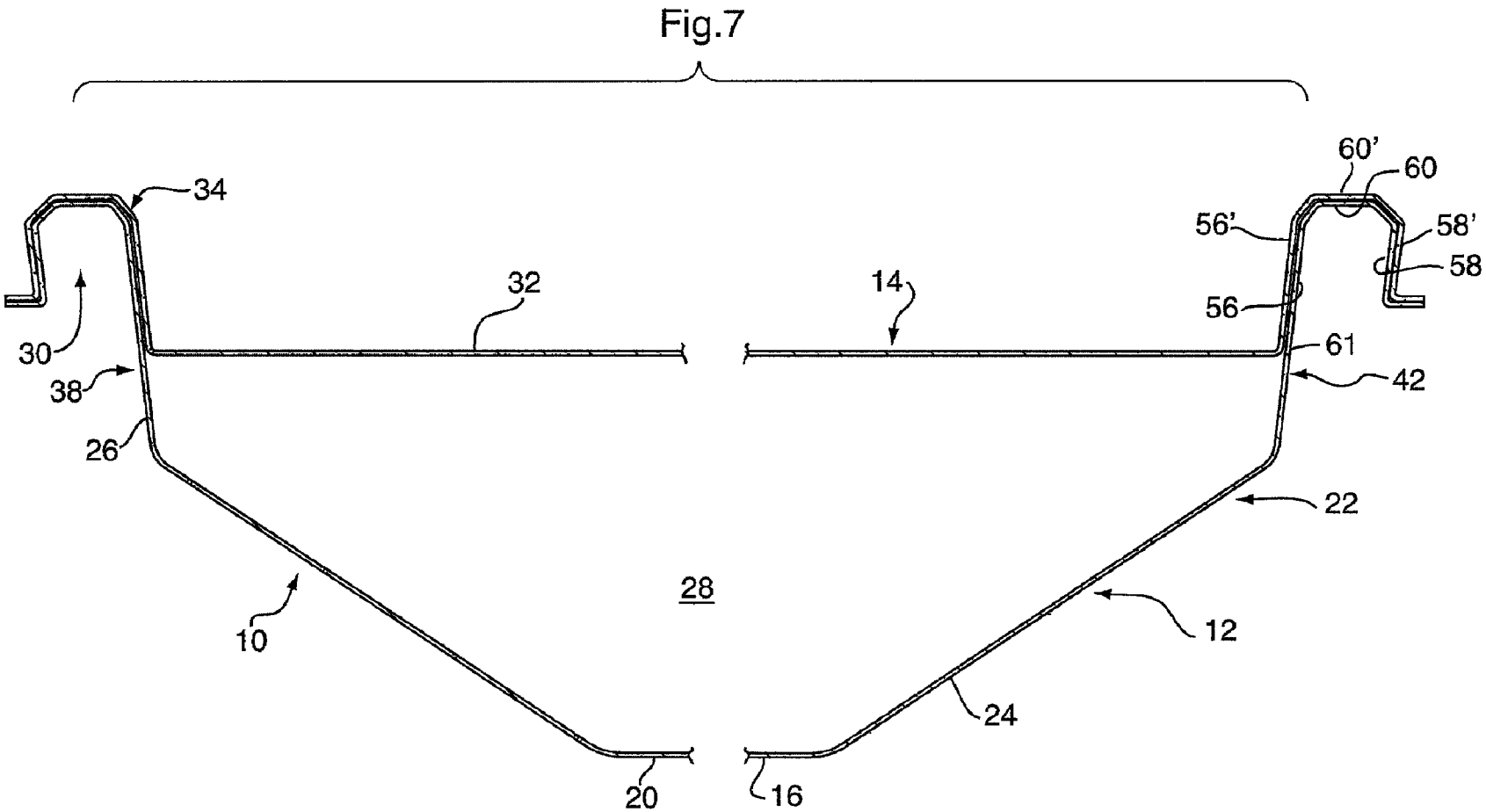
FIG. 7 is a cross-section along line 7-7 of FIG. 1.

As can be seen from FIG. 7, the inner wall 56 of the tray peripheral edge portion 30 extends upwardly from the upper edge of sidewall 22. In the container 10 shown in the drawings, the sidewall 22 includes an upper vertical portion 26 and therefore there is no clear transition between the upper edge of the sidewall 22 and the inner wall 56, at least along the sides 36, 38, 40, 42. For the purpose of this description, it will be assumed that the lower edge of the inner wall 56 of the tray peripheral edge portion 30 is coplanar with the central panel 32 of lid 14 when the container 10 is closed as shown in FIG. 7. The lower edge of inner wall 56 and the upper edge of sidewall 22 are both identified by reference numeral 61 in the drawings.

The inner wall 56' of the lid peripheral edge portion 34 extends upwardly from the central panel 32, and therefore the panel 32 is inset relative to the peripheral flange 60', which is beneficial for stacking of containers 10.

When the container 10 is closed, the tray peripheral edge portion 30 is substantially completely nested inside a cavity defined by the walls, 56, 58 and flange 60 of the lid peripheral edge portion 34. With the peripheral edge portions 30, 34 nested as shown in FIG. 7, the inner wall 56, outer wall 58 and flange 60 are in substantial engagement with the inner wall 56', outer wall 58' and flange 60' of the lid peripheral edge portion 34. In order to permit nesting of the peripheral edge portions 30, 34, the flange 60 of the tray peripheral edge portion 30 is slightly narrower than the flange 60' of the lid peripheral edge portion 34.

The container 10 is also provided with at least one detent mechanism which is formed in the outer walls 58 of both the tray and lid peripheral edge portions 30, 34, and is therefore referred to herein as the "outer detent mechanism" and generally identified by reference numeral 62. In the embodiment shown in the drawings, container 10 is provided with two such outer detent mechanisms 62, one located at each of the chamfered corners 46, 50. The outer detent mechanism 62 is now described with reference to the FIGS. 5 and 6, comprising vertical cross-sections through chamfered corner 50 in the closed (FIG. 5) and opened (FIG. 6) configurations.

Figure 5:
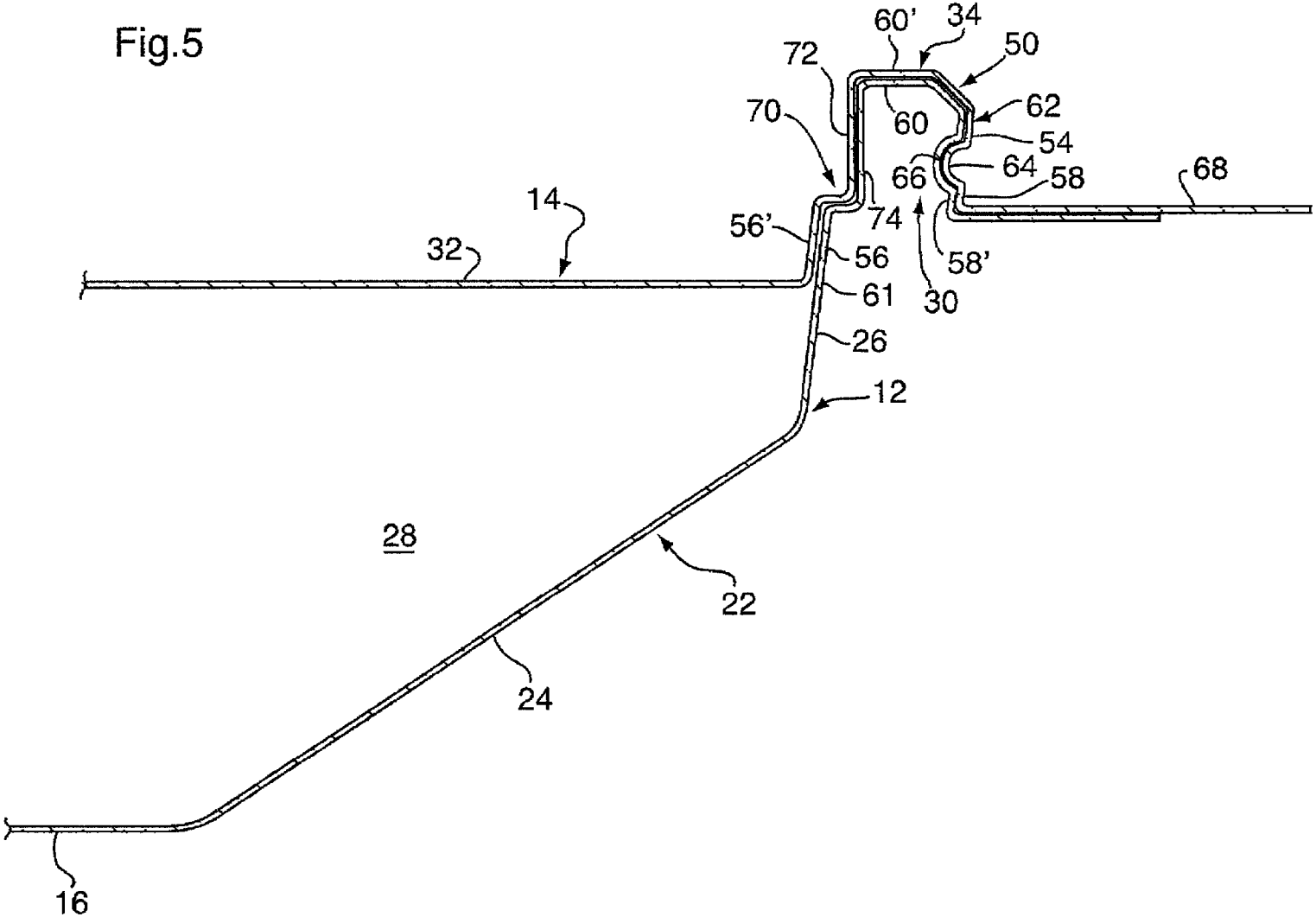
FIG. 5 is a cross-section along line 5-5 of FIG. 1.
Figure 6:
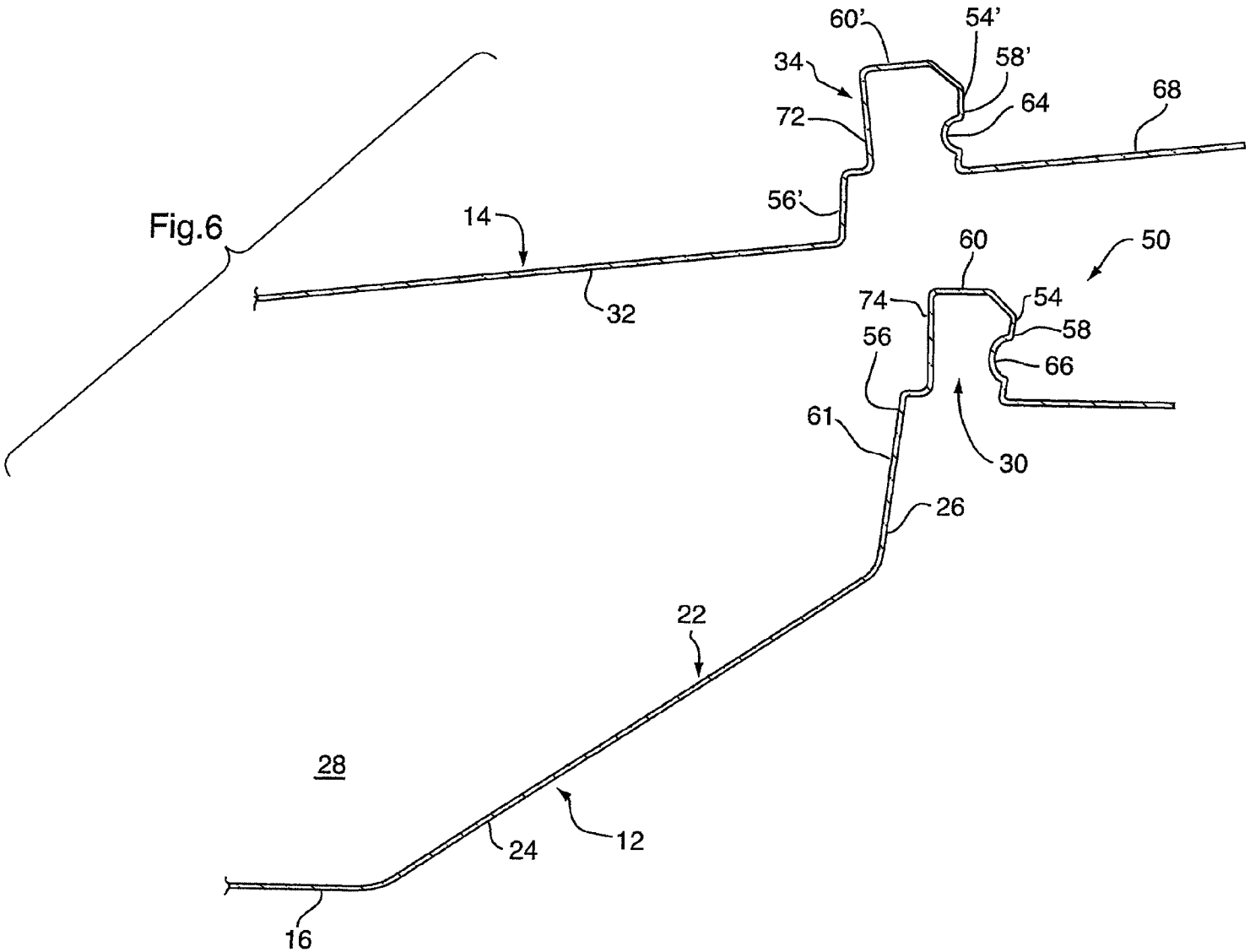
FIG. 6 is a cross-section similar to FIG. 5, but showing the lid separated from the tray.

Each outer detent mechanism 62 comprises a male detent element 64 projecting inwardly from the outer wall 58' of the lid peripheral edge portion 34, and a corresponding female detent element 66 projecting inwardly from the outer wall 58 of the tray peripheral edge portion 30. When the container 10 is closed as shown in FIG. 5, with the tray peripheral edge portion 30 substantially completely received within the lid peripheral edge portion 34, the male detent element 64 is received within, and nested with, the female detent element 66. It is therefore apparent from FIG. 5 that the male and female detent elements 64, 66 in each outer detent mechanism 62 must be positioned directly opposite one another on the respective outer walls 58, 58' of the peripheral edge portions 30, 34. In the outer detent mechanism 62 shown in the drawings, the male detent element 64 is made up of a series of discrete protrusions or dimples, and the female detent element similarly comprises a series of discrete projections or dimples of slightly greater size. More specifically, each of the male and female detent elements 64, 66 is made up of two such projections or dimples in the illustrated embodiment of FIGS. 1 to 7.

Figure 9:
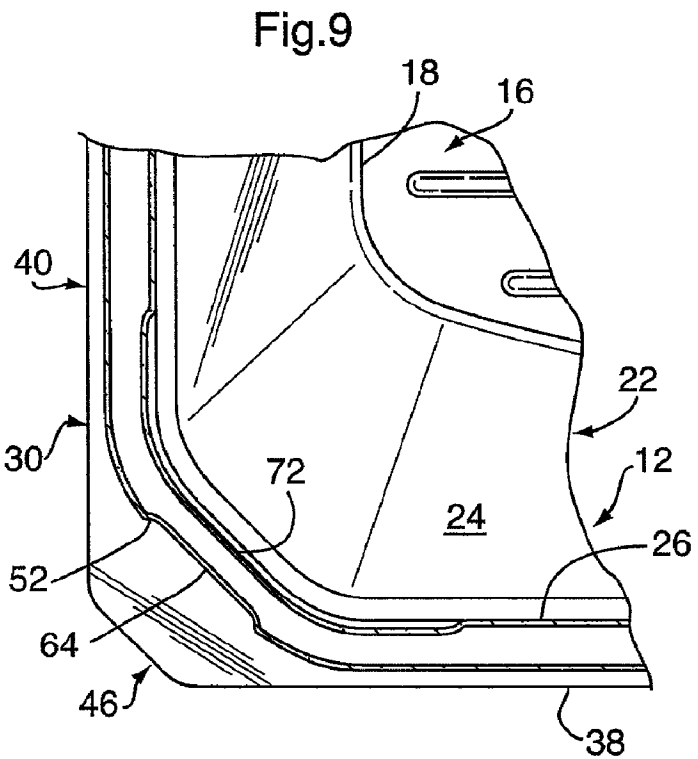
FIG. 9 is a cross-sectional plan view through the upper flange at the corner shown in FIG. 8.
Figure 8:
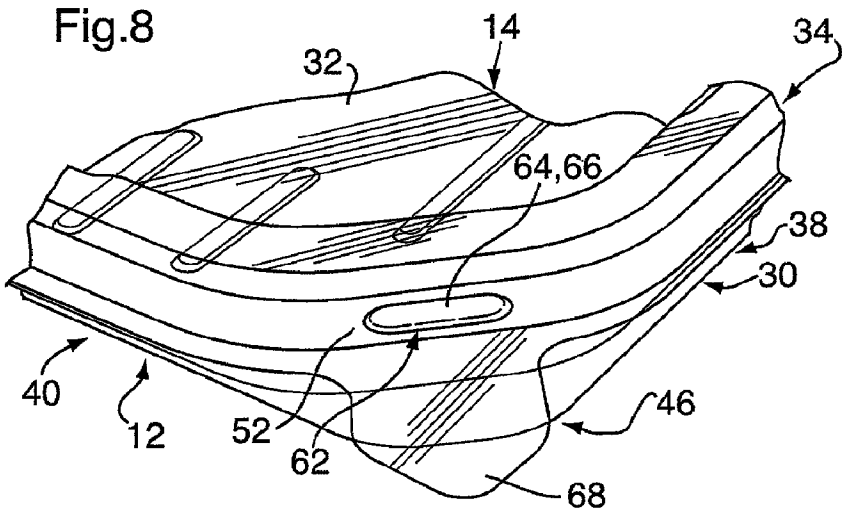
FIG. 8 is a perspective view of a corner of a container according to a second embodiment of the invention.

It will be appreciated that the detent mechanism 62 may comprise fewer or more male and female detent elements 64, 66 than shown in FIGS. 1 to 7, and that the detent elements 64, 66 may be shaped differently from those shown in FIGS. 1 to 7. For example, FIGS. 8 and 9 show a slight variant of one corner 46 of container 10 in which the outer detent mechanism 62 comprises only one male detent element 64 and only one female detent element 66, each comprising an elongate rib. The number and size of the detent elements 64, 66 is at least partly determined by the desired amount of force needed to open and close container 10. For example, it would be expected that the detent mechanism 62 of FIGS. 8 and 9, having relatively enlarged detent elements 64, 66, would require slightly more force to open and close than the detent mechanism 62 of FIGS. 1 to 7.

The angle which the detent elements 64, 66 make with the outer walls 58, 58' of the tray and lid peripheral edge portions 30, 34 also has an impact on the force required to open and close the container 10. In the examples shown in the drawings, the detent elements 64, 66 project inwardly from outer walls 58, 58' at an angle in the range of about 45-90 degrees from vertical, for example about 60-90 degrees from vertical, at least when viewed in a cross-section in a vertical plane, as in FIGS. 5 and 6. For example, when viewed in a vertical plane passing through the detent elements 64, 66, sharp, abrupt transitions are formed between the upper and lower surfaces of detent elements 64, 66 and the outer walls 58, 58', and the angles between the upper and lower surfaces of detent elements 64, 66 and the outer walls 58, 58' fall within the ranges mentioned above. Since the lid 14 is removed by pulling upwardly and outwardly, the angle between the detent elements 64, 66 and the outer walls 58, 58', when viewed in a cross-section in a horizontal plane, as shown in FIG. 4, is less critical, and may be less than the ranges mentioned above.

The shape of the detent elements 64, 66 is such that a significant force is required to engage and disengage the outer detent elements 64, 66 relative to their small area. A pair of such outer detent mechanisms 62 at diagonally opposite corners is sufficient to keep the lid 14 from accidentally becoming separated from tray, and also provides the user with a definite audible and/or tactile sensation to indicate that the container 10 is either open or closed.

Figure 2:
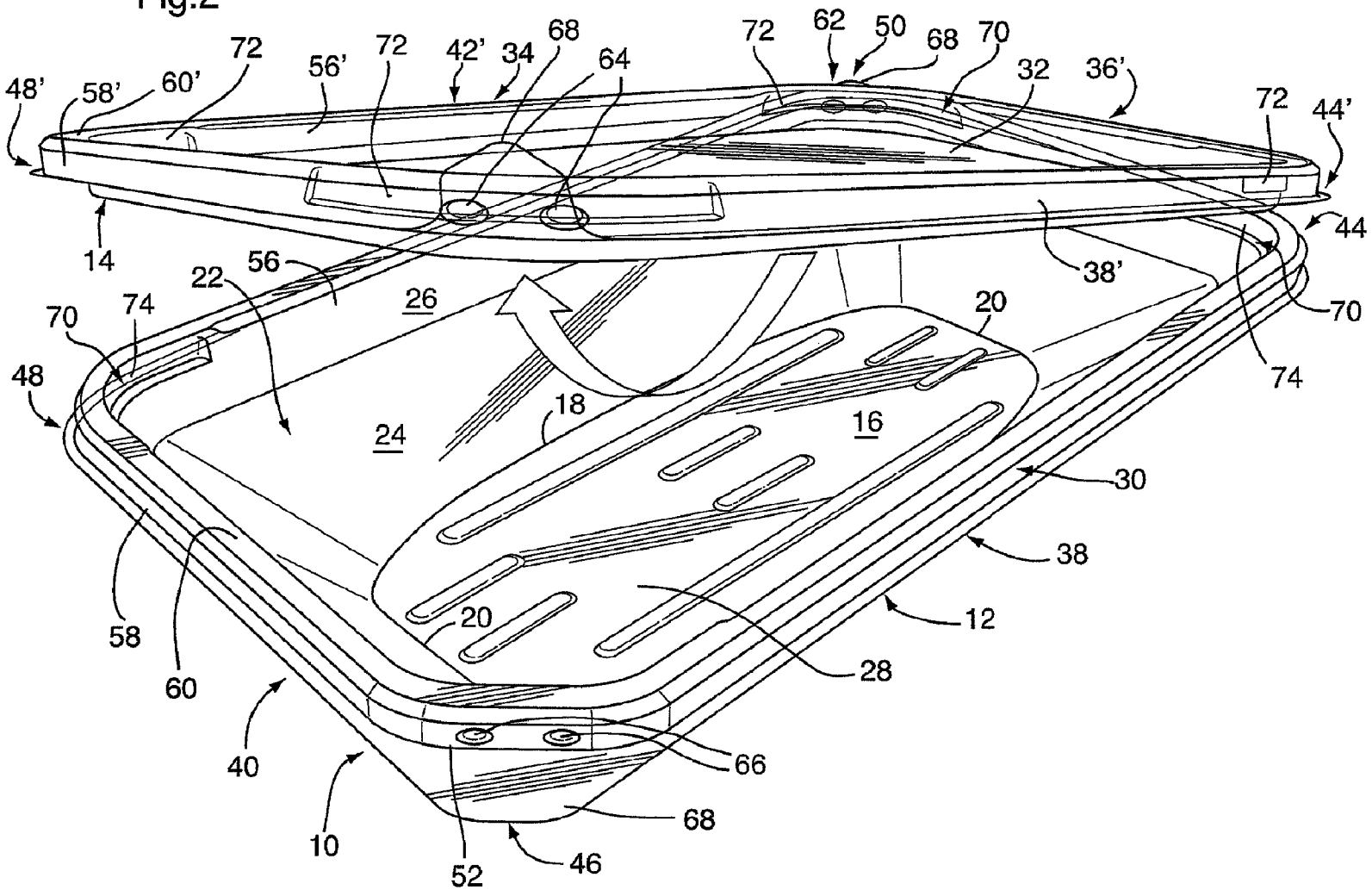
FIGS. 2 and 3 are perspective views of the container of FIG. 1, showing the lid being separated from the tray.
Figure 3:
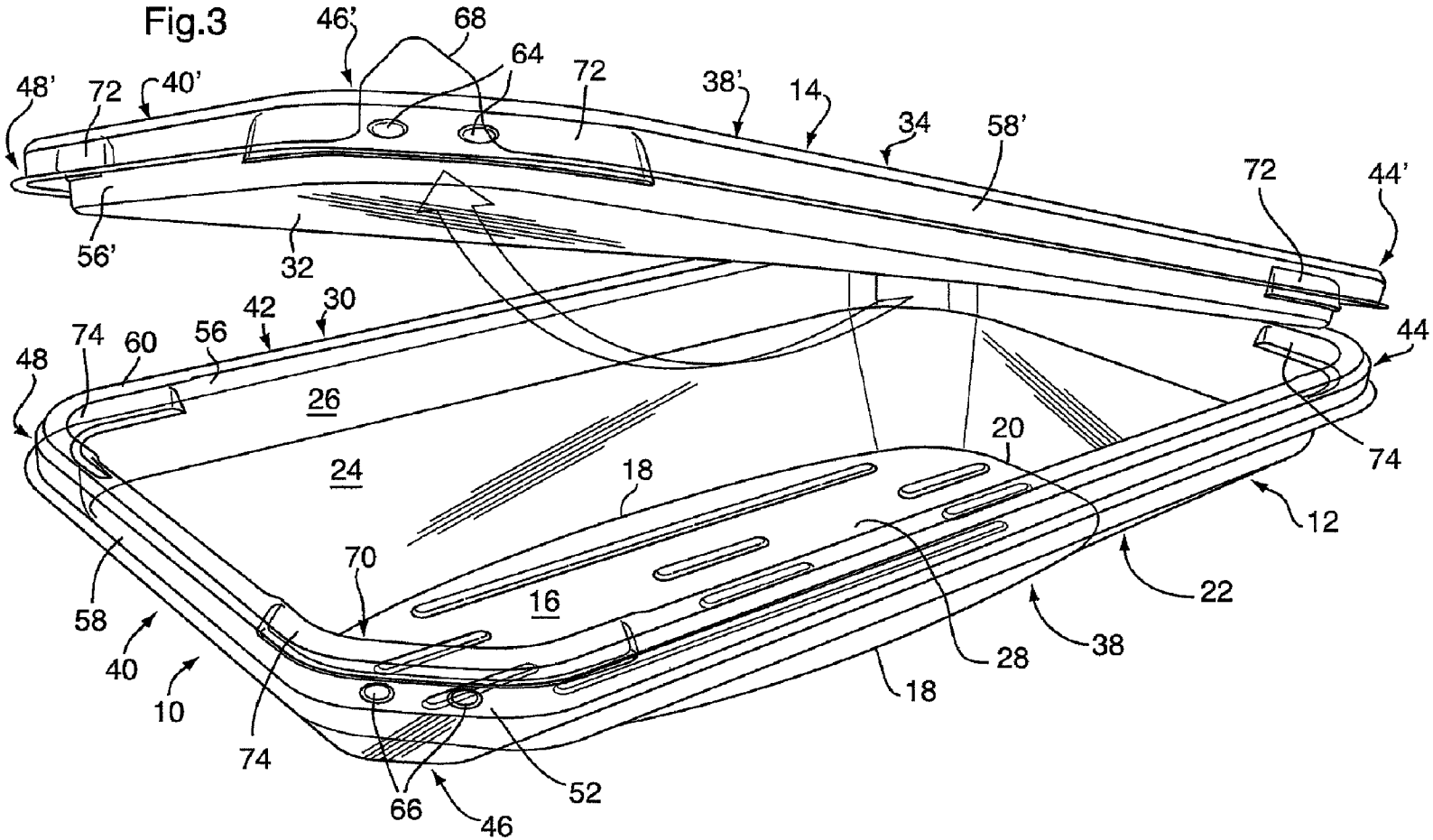

The container 10 further comprises at least one lift tab 68 projecting outwardly from the lower edge of the outer wall 58' of lid peripheral edge portion 34. The lift tab 68 provides an area to be gripped by the user and pulled upwardly to separate the lid 14 from the tray 12, thereby opening the container 10 as shown in FIGS. 2 and 3. Although container 10 includes two lift tabs 68 to permit the container 10 to be opened from either end, it will be appreciated that only one tab 68 needs to be lifted during opening of the container 10. Therefore, container 10 could be provided with only one lift tab 68 without affecting ease of opening.

The lift tabs 68 are located at the chamfered corners 46, 50 at which the outer detent mechanisms 62 are located. More specifically, the lift tabs 68 extend outwardly from the straight portions 52, 54 of the chamfered corners 46, 50 and are directly aligned with the detent elements 64, 66. This permits the detent mechanisms 62 at each chamfered corner 46, 50 to become easily disengaged by lifting the tab 68.

The container 10 may also be provided with at least one detent mechanism which is formed in the inner walls 56 of both the tray and lid peripheral edge portions 30, 34, and is therefore referred to herein as the "inner detent mechanism" and generally identified by reference numeral 70. An inner detent mechanism 70 may be provided at one or more corners of container 10, and or at least the corners 46, 50 which also have an outer detent mechanism 62. In the specific embodiment shown in the drawings, all four corners 44, 46, 48, 50 are provided with an inner detent mechanism 70. The inner detent mechanism 70 is now described with reference to FIGS. 4 to 6.

Each inner detent mechanism 70 comprises a male detent element 72 projecting outwardly from the inner wall 56' of the lid peripheral edge portion 34, and a corresponding female detent element 74 projecting outwardly from the inner wall 56 of the tray peripheral edge portion 30. As with the outer detent mechanism 62 described above, the male and female elements 72, 74 of the inner detent mechanism 70 are also positioned so that the male detent element 72 becomes nested with the female detent element 74 when the container 10 is closed as shown in FIG. 5.

The male and female element 72, 74 of the inner detent mechanism 70 are shaped so as to engage one another relatively weakly compared to the outer detent mechanism 62. Therefore, the inner detent mechanisms 70 by themselves provide little resistance against opening or closing of container 10.

In the embodiment shown in the drawings, the male and female detent elements 72, 74 are in the form of horizontally elongated ribs. When viewed in the vertical cross-sections of FIGS. 5 and 6, it can be seen that the detent elements 72, 74 extend downwardly from the upper flange 60 and along the inner wall 56 of the tray and lid peripheral edge portions 30, 34. The detent elements 72, 74 slope outwardly and downwardly at a small angle from vertical and are therefore somewhat wedge-shaped when viewed in cross-section. Due to the small angle at which they are sloped, the detent elements 72, 74 engage each other weakly, so that very little force is required to engage or disengage the inner detent elements 72, 74. Moreover, the amount of force required to engage or disengage detent elements 72, 74 is significantly less than that required to engage and disengage the male and female elements 64, 66 of the outer detent mechanism 62.

As shown in FIG. 4, which is a horizontal cross-sectional or plan view showing tray 12 in isolation, each inner detent mechanism 70 wraps around one of the corners 44, 46, 48, 50 and extends along portions of two adjoining sides 36, 38, 40, 42. Despite the fact that each inner detent mechanism 70 occupies significantly greater area than each outer detent mechanism 62, the small angle of slope referred to above ensures that the detent elements 72, 74 engage each other weakly.

Aside from the portions of the detent mechanisms 70 which extend past the corners 44, 46, 48, 50 of the tray and lid peripheral edge portions, the sides 36, 38, 40, 42 are substantially flat and planar, and free of projections. This is illustrated in FIG. 7, showing a cross-section transverse to the elongate sides 36, 40. Along the sides of the tray and lid peripheral edge portions 30, 34, the inner and outer sidewalls 56, 58 are substantially flat, vertical and parallel to one another. Therefore, any frictional engagement between the tray and lid peripheral edge portions 30, 34 along the sides 36, 38, 40, 42 offers very little resistance to opening and closing of the container 10.

Opening of container 10 will now be described with reference to FIGS. 1 to 3. FIG. 1 shows the container 10 in its closed configuration, either before or after initial opening and removal of a portion of the food product (not shown). FIGS. 2 and 3 show the container 10 in a partially opened state, from slightly different angles. In the closed configuration of FIG. 1, the tray peripheral edge portion 30 is substantially completely received within the lid peripheral edge portion 34 about its entire periphery, as in FIGS. 5 and 7, so that the inner wall 56, outer wall 58 and flange 60 of the tray peripheral edge portion 30 are in substantial engagement with the respective inner wall 56', outer wall 58' and flange 60' of the lid peripheral edge portion 34. In the closed configuration, the male and female elements 64, 66 of each outer detent mechanism 62 are in nested engagement as shown in FIG. 5, as are the male and female elements 72, 74 of each inner detent mechanism 70.

With the container 10 closed, the lift tabs 68 project horizontally outwardly of the outer periphery of tray 12. To open the container 10, the user (not shown) grasps one of the lift tabs 68 and pulls it upwardly and outwardly. In the following description, the container 10 is opened using tab 68 located at chamfered corner 46. Therefore, unless otherwise indicated below, the tab 68 and the corresponding outer detent mechanism 62 referred to in the following discussion are those located at chamfered corner 46.

Due to the direct proximity between each lift tab 68 and the corresponding outer detent mechanism 62, the initial pulling and lifting of tab 68 is sufficient to overcome the force of the outer detent elements 64, 66, causing them to become disengaged from one another. The plastic film has some "give" and therefore pulling and lifting of the tab 68 results in some outward displacement of the outer wall 58' of the lid peripheral edge portion 34 (possibly accompanied by inward displacement of the outer wall 58 of the tray peripheral edge portion 30), to assist in disengagement of the detent elements 64, 66. The disengagement of the outer detent elements 64, 66 may be accompanied by a tactile sensation and/or an audible sound to indicate that the lid 14 has become separated from tray 12 at corner 46. The male and female elements 72, 74 of inner detent mechanism 70 at corner 40 also become disengaged during lifting of tab 68, and offer little resistance to opening.

Once the detent mechanisms 62, 70 at corner 46 are disengaged, the user continues to lift tab 68 as shown in FIGS. 2 and 3 to progressively lift the lid 14 away from tray 12. First, the sides 38', 40' of lid peripheral edge portion 34 adjoining corner 46' become separated from the tray peripheral edge portion 30. The flat, planar shape of the inner and outer walls 56, 58 (FIG. 7) along the sides 38, 40 offer little resistance against separation of the lid 14 from tray 12.

Continued lifting of the tab 68 results in the disengagement of the inner detent mechanisms 70 located at rounded corners 44, 48, possibly with a further audible sound or tactile sensation. Once these inner detents 70 are disengaged, the two remaining sides 38', 42' of the lid peripheral edge portion 34 are easily separated from the tray peripheral edge portion 30 by continued lifting of tab 68, such that the only remaining point of engagement between tray 12 and lid 14 is at the chamfered corner 50 where the other outer detent mechanism 62 is located. This configuration is shown in FIGS. 2 and 3.

Once the lid is lifted to the extent shown in FIGS. 2 and 3, further lifting of the tab 68 causes the lid 14 to pivot at corner 50, about an axis which is either coincident with or in close proximity to the straight portion 54 of the chamfer at corner 50. This pivoting motion causes the outer wall 58' of the lid peripheral edge portion 34 to pivot away from the outer wall 58 of the tray peripheral edge portion 30. This results in outward displacement, and ultimate disengagement, of the male detent element 64 from the female detent element 66 at corner 50. Similarly, the pivoting movement of lid 14 overcomes the relatively weak resistance of the inner detent mechanism 70 at corner 50. The disengagement of detent mechanisms 62, 70 at corner 50 results in complete disengagement and removal of lid 14 from tray 12. The disengagement of the outer detent mechanism 62 at corner 50 may be accompanied by an audible sound and/or a tactile sensation.

It will be appreciated that the pivoting of the lid 14 about the straight portion 54 at corner 50 permits the lid 14 to be removed without the need for the user to pull or lift the tab 68 at corner 50. In this way, the container 10 according to the invention is opened with one lifting movement.

Closing of container 10 is accomplished by placing the lid 14 over the open tray 12 with the lid peripheral edge portion 34 overlying the tray peripheral edge portion 30. The user then pushes down on the lid 14 or the lid peripheral edge portion 34 so as to push the lid peripheral edge portion 34 over the tray peripheral edge portion 30 until the container is completely closed as in FIGS. 5 and 7. For example, the user need only push down at chamfered corners 46, 50 to completely close the tray 10. The engagement of the outer detent mechanisms 62 at corners 46, 50 may be accompanied by an audible sound or a tactile sensation.

Although the invention has been described above with reference to a specific container 10, it will be appreciated that modifications to the container can be made without departing from the scope of the invention. For example, due to the fact that the inner detent mechanisms 70 provide only weak engagement between the tray 12 and lid 14, the inner detent mechanisms 70 may be completely eliminated or may be located at fewer than four corners without significantly affecting the opening and closing of the container.

Although container 10 does not include an outer detent mechanism 62 at the two rounded corners 44, 48, it will be appreciated that this is not necessarily the case. For example, the container 10 may be modified by adding an outer detent mechanism at these corners, which may be of the same or different configuration as the outer detent mechanisms 62 located at chamfered corners 46, 50. Where the resulting container has strongly engaging outer detent mechanisms 62 located at each corner 44, 46, 48, 50, the container will be somewhat more resistant to opening and closing. It is also possible to provide corners 44, 48 with weakly engaging outer detent mechanisms similar in configuration to the weakly engaging inner detent mechanisms 70 described above.

In the outer detent mechanism 62 described above, the male detent element 64 projects inwardly from the outer wall 58' of the lid peripheral edge portion 34 and the female detent element 66 projects inwardly from the outer wall 58 of the tray peripheral edge portion 30. It will be appreciated, however, that the configuration of the detent elements can be reversed such that male detent element 64 projects outwardly from the outer wall 58 of the tray peripheral edge portion 30 and the female detent element 66 projects outwardly from the outer wall 58' of the lid peripheral edge portion 34.

Although the invention has been described in connection with certain preferred embodiments, it is not limited thereto. Rather, the invention includes all embodiments which may fall within the scope of the following claims.

What is claimed is:

1. A reclosable container for a food product, comprising:

(a) a tray having a base and an upstanding sidewall extending from the base, the base and the sidewall together defining a compartment for the food product, the sidewall terminating in a peripheral edge portion;

(b) a lid having a central panel surrounded by a peripheral edge portion;

wherein the peripheral edge portions of the tray and lid each have four sides and four corners, and wherein the peripheral edge portions each comprise an inner wall, an outer wall spaced from the inner wall, and a flange connecting the inner and outer walls at their upper edges, wherein the inner wall of the tray peripheral edge portion extends upwardly from the sidewall, and the inner wall of the lid peripheral edge portion extends upwardly from the central panel of the lid;

(c) a first outer detent mechanism which is located at a first corner of the lid peripheral edge portion and a corresponding first corner of the tray peripheral edge portion, wherein the first outer detent mechanism comprises a male detent element projecting inwardly from the outer wall of the lid peripheral edge portion, and a female detent element projecting inwardly from the outer wall of the tray peripheral edge portion, wherein the male and female detent elements are positioned so that the male detent element is nested with the female detent element when the container is closed;

wherein the inner and outer walls of the tray and lid peripheral edge portions are, along the sides thereof, substantially flat and planar, and substantially free of projections.

2. The container according to claim 1, wherein the peripheral edge portions of the tray and the lid are generally rectangular.

3. The container according to claim 1, wherein the first corner at which said first outer detent mechanism is located is shaped to define a first corner transition portion which forms an included angle of greater than 90 degrees with each of the adjoining sides, and wherein the first outer detent mechanism is located at said first corner transition portion.

4. The container according to claim 3, wherein the first corner transition portion includes a substantially straight portion which forms an included angle of about 135 degrees with each of the adjoining sides.

5. A container according to claim 3, wherein the first outer detent mechanism is provided in the substantially straight portion of said first corner transition portion.

6. A container according to claim 1, wherein the male detent element projects inwardly at an angle of about 45-90 degrees to the outer wall of the lid peripheral edge portion, and the female detent element projects inwardly at an angle of about 45-90 degrees to the outer wall of the tray peripheral edge portion, said angle being defined in a vertical plane passing through the first outer detent element.

7. A container according to claim 6, wherein the male detent element projects inwardly at an angle of about 60-90 degrees to the outer wall of the lid peripheral edge portion, and the female detent element projects inwardly at an angle of about 60-90 degrees to the outer wall of the tray peripheral edge portion, said angle being defined in a vertical plane passing through the first outer detent element.

8. A container according to claim 6, wherein the male detent element projects sharply and abruptly inwardly from the outer wall of the lid peripheral edge portion, and the female detent element projects sharply and abruptly inwardly from the outer wall of the tray peripheral edge portion, when the male and female detent elements are viewed in a vertical plane passing through the first outer detent element.

9. A container according to claim 6, wherein the male and female detent elements each comprise one or more dimples having upper and lower surfaces spaced from the respective upper and lower edges of the outer walls of the tray and lid peripheral edge portions.

10. A container according to claim 1, wherein the container further comprises a second outer detent mechanism located at a second corner of the lid peripheral edge portion and a corresponding corner of the tray peripheral edge portion, wherein the second outer detent mechanism comprises a male detent element projecting inwardly from the outer wall of the lid peripheral edge portion, and a female detent element projecting inwardly from the outer wall of the tray peripheral edge portion, wherein the male and female detent elements are positioned so that the male detent element is nested with the female detent element when the container is closed, and wherein the male and female detent elements of the second detent mechanism are of substantially the same shape and size as the respective male and female detent elements of the first detent mechanism.

11. A container according to claim 10, wherein the first and second corners are diagonally opposite to one another, and wherein the second corner is shaped to define a second corner transition portion at which the second outer detent mechanism is located, and wherein the second corner transition portion includes a substantially straight portion which forms an included angle of about 135 degrees with each of the adjoining sides.

12. A container according to claim 1, further comprising at least one lift tab extending outwardly from the outer wall of the lid peripheral edge portion at said corner at which said first outer detent mechanism is located.

13. A container according to claim 1, further comprising at least one inner detent mechanism located at a corner of the lid peripheral edge portion and a corresponding corner of the tray peripheral edge portion, wherein each said inner detent mechanism comprises a male detent element projecting outwardly from the inner wall of the lid peripheral edge portion and a corresponding female detent element projecting outwardly from the tray peripheral edge portion.

14. A container according to claim 13, wherein the male and female detent elements of the at least one inner detent mechanism are shaped so as to engage one another relatively weakly in comparison to the male and female detent elements of the first outer detent element.

15. A container according to claim 13, wherein the male and female detent elements of the at least one inner detent mechanism are in the form of horizontally elongated ribs having a wedge shape when viewed in a vertical cross-section.

16. A container according to claim 15, wherein each of the at least one inner detent mechanisms wraps around one of the corners and extends along portions of two adjoining sides.

17. A container according to claim 13, wherein the peripheral edge portions of the tray and the lid are generally rectangular, and wherein said container includes four of said inner detent mechanisms, each of which is located at one of the corners.

* * * * *